United States Patent [19]

Brown et al.

[11] 4,109,855

[45] Aug. 29, 1978

[54] DRIVE SYSTEM FOR CENTRIFUGAL PROCESSING APPARATUS

[75] Inventors: Richard I. Brown, Northbrook; Joseph Kevin Duffy, Buffalo Grove, both of Ill.

[73] Assignee: Baxter Travenol Laboratories, Inc., Deerfield, Ill.

[21] Appl. No.: 844,607

[22] Filed: Oct. 25, 1977

[51] Int. Cl.[2] ..... B04B 5/02; B04B 9/08

[52] U.S. Cl. ..... 233/25; 233/26

[58] Field of Search ..... 233/23 R, 24, 25, 26, 233/1 R; 74/467

[56] References Cited

U.S. PATENT DOCUMENTS

| | | | |
|---|---|---|---|
| 3,885,735 | 5/1975 | Westberg | 233/25 |
| 3,986,442 | 10/1976 | Khoja et al. | 233/25 X |

*Primary Examiner*—George H. Krizmanich

*Attorney, Agent, or Firm*—Henry W. Collins; Paul C. Flattery; George H. Gerstman

[57] ABSTRACT

Centrifugal processing apparatus in which a processing chamber is rotatably mounted with respect to a stationary base. An umbilical cable segment is fixed at one end substantially along the axis of the processing chamber at one side thereof, with the other end of the cable segment being attached substantially on the axis in rotationally locked engagement to the processing chamber. A coaxial main drive shaft is provided and is driven at a first angular velocity. The cable segment extends from its location in rotationally locked engagement to the processing chamber, through a central bore defined by the main drive shaft and radially outwardly therefrom. Power is transmitted to the processing chamber via a transmission countershaft which is parallely located with respect to the main drive shaft and operative to turn in the direction opposite to the direction of the main drive shaft. The countershaft is coupled so that when the main drive shaft is driven at the first angular velocity, the processing chamber will effectively rotate at twice the first angular velocity. The construction of the processing system is such that the drive is substantially hidden and requires a relatively small number of seals.

13 Claims, 4 Drawing Figures

FIG. 1
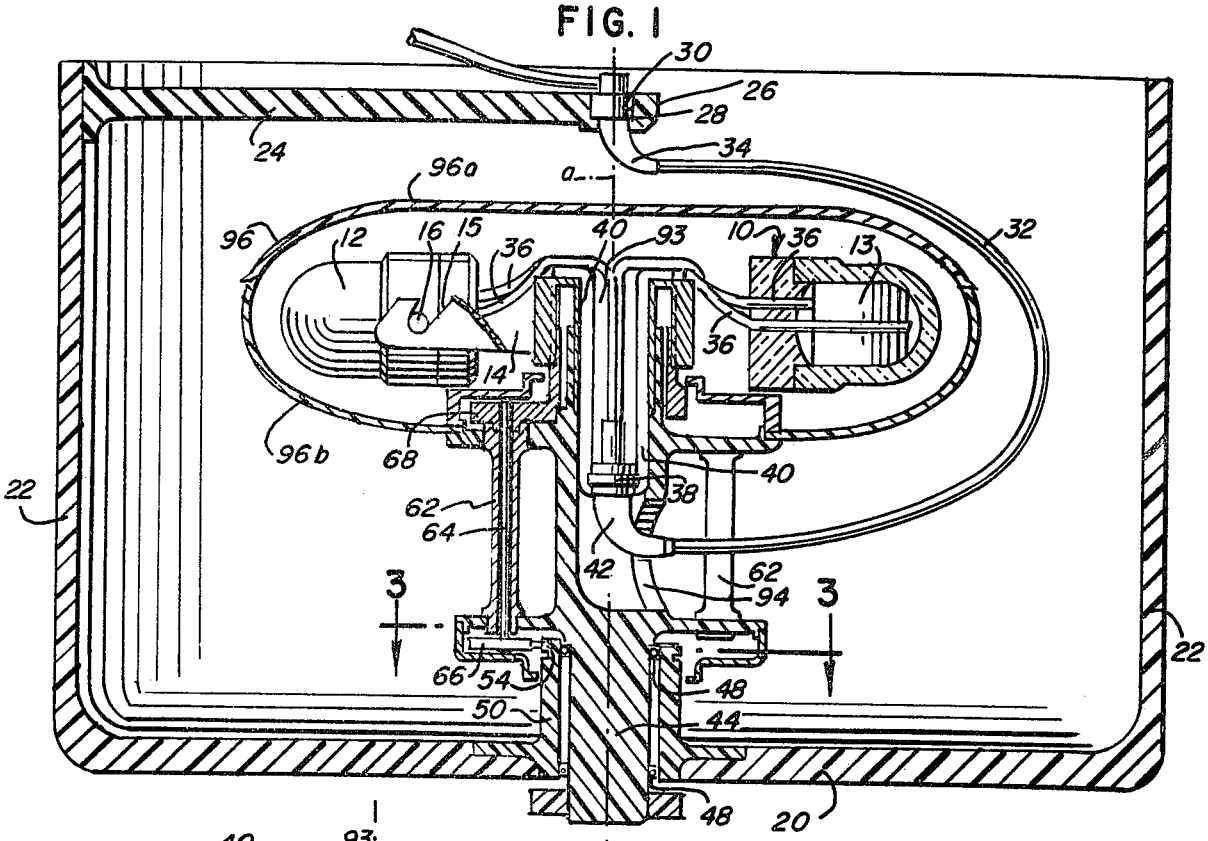
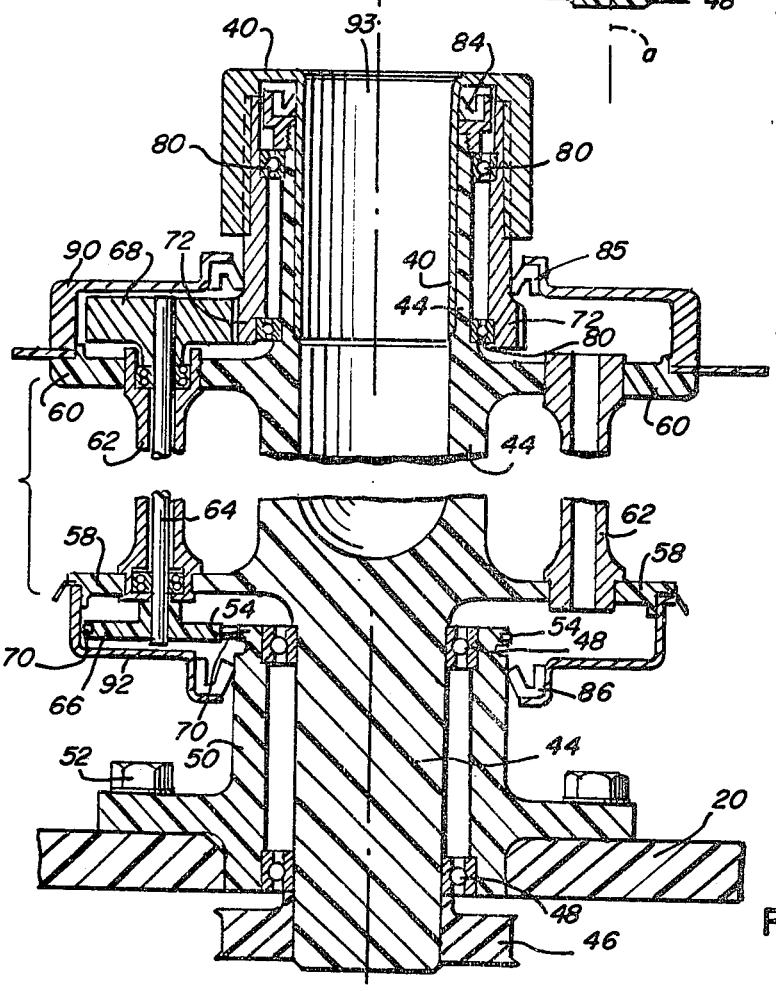
FIG. 2
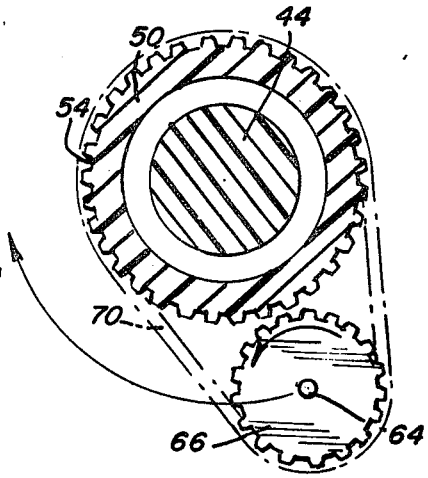
FIG. 3

DRIVE SYSTEM FOR CENTRIFUGAL PROCESSING APPARATUS

BACKGROUND OF THE INVENTION

The present invention concerns centrifugal processing apparatus and, more particularly, apparatus employing umbilical tubing which is rotated with respect to a stationary base.

Centrifugal processing systems are used in many fields. In one important field of use, a liquid having a suspended mass therein is subjected to centrifugal forces to obtain separation of the suspended mass.

As a more specific example, although no limitation is intended herein, in recent years the long term storage of human blood has been accomplished by separating out the plasma component of the blood and freezing the remaining blood cell component in a liquid medium, such as glycerol. Prior to use, the glycerolized red blood cells are thawed and pumped into the centrifugating wash chamber of a centrifugal liquid processing apparatus. While the red blood cells are being held in place by centrifugation, they are washed with a saline solution which displaces the glycerol preservative. The resulting reconstituted blood is then removed from the wash chamber and packaged for use.

The aforementioned blood conditioning process, like other processes wherein a liquid is caused to flow through a suspended mass under centrifugation, necessitates the transfer of solution into and out of the rotating wash chamber while the chamber is in motion. Thus while glycerolized red blood cell and saline solution are passed into the wash chamber, waste and reconstituted blood solutions are passed from the chamber. To avoid contamination of these solutions, or exposure of persons involved in the processing operation to the solutions, the transfer operations are preferably carried out within a sealed flow system.

One type of centrifugal processing system which is well adapted for the aforementioned blood conditioning process uses the principles of operation described in Dale A. Adams U.S. Pat. No. 3,586,413. The apparatus of the Adams patent establishes fluid communication between a rotating chamber and stationary reservoirs through a flexible interconnecting umbilical cord without the use of rotating seals, which are expensive to manufacture and which add the possibility of contamination of the fluid being processed.

The primary embodiment of the Adams patent comprises a rotating platform which is supported above a stationary surface by means of a rotating support. A tube is connected to the stationary support along the axis of the rotating platform and the rotating support, with the tube extending through the rotating support and having one end fastened to the axis of the rotating platform. A motor drive is provided to drive both the rotating platform and the rotating support in the same relative direction at speeds in the ratio of 2:1, respectively. It has been found that by maintaining this speed ratio, the tube will be prevented from becoming twisted. An improvement with respect to this principle of operation, comprising a novel drive system for a centrifugal liquid processing system, is disclosed in Khoja, et al. U.S. Pat. No. 3,986,442. In the Khoja, et al. patent, a novel drive system is provided for driving a rotor assembly at a first speed and a rotor drive assembly at one-half the first speed, in order to prevent an umbilical tube from becoming twisted.

It is desirable that the centrifugal processing apparatus permits simple access for cleaning, be attractive in appearance, be relatively simple to load, have minimum sealing requirements and have good stability. To this end, it has been found that superior support is effected by means of a central axially aligned main drive shaft. It is also desirable that the cable segment be extended through the main drive shaft with the main drive shaft turning at an angular velocity that is one-half the angular velocity of the processing chamber.

Thus, it is an object of the present invention to provide centrifugal processing apparatus having a central main drive shaft which is coaxial with the axis of rotation of the processing chamber.

Another object of the present invention is to provide centrifugal processing apparatus in which the cable segment extends through the central main drive shaft and a transmission countershaft is utilized for doubling the angular velocity of the processing chamber with respect to the angular velocity of the main drive shaft.

A further object of the present invention is to provide centrifugal processing apparatus which is attractive in appearance, relatively easy to clean and requires a relatively small number of fluid seals.

A further object of the present invention is to provide centrifugal processing apparatus which is relatively simplified in construction and efficient to manufacture.

Other objects and advantages of the present invention will become apparent as the description proceeds.

BRIEF DESCRIPTION OF THE INVENTION

In accordance with the present invention, centrifugal processing apparatus is provided which comprises a stationary base and a processing chamber rotatably mounted with respect to the base for rotation about a predetermined axis. A flexible umbilical cable segment is provided for establishing communication with the processing chamber. One end of the cable segment is fixed with respect to the base substantially along the axis at one side of the processing chamber. The cable segment extends around the processing chamber with the other end of the cable segment attached substantially on the axis in rotationally locked engagement to the processing chamber.

A main drive shaft is connected to the processing chamber with the main drive shaft being coaxial with the predetermined axis. Means are provided for driving the main drive shaft at one $\omega$.

The main drive shaft defines a central bore and an opening extending radially from the central bore to the outside of the main drive shaft. The cable segment extends from the other end through the central bore and the radially extending opening, and out of the main drive shaft.

In the illustrative embodiment a transmission countershaft is coupled to the base and main drive shaft adjacent one end thereof. The transmission countershaft is coupled to the processing chamber and main drive shaft adjacent the other end thereof. The countershaft is parallely located with respect to the main drive shaft and is operative to turn in a direction opposite to the direction of the main drive shaft.

First means are provided for coupling the countershaft to the base and main drive shaft to cause counterrotation of the countershaft in response to rotation of the main drive shaft. In the illustrative embodiment, the first coupling means comprise a first drive member affixed to the base and a second drive member carried with the main drive shaft, with means coupling the first and second drive members to establish a predetermined gear ratio.

Second means are provided for coupling the countershaft to the processing chamber and main drive shaft to transmit one ω rotation to the processing chamber during counter-rotation of the countershaft. The transmitted one ω rotation is added to the one ω rotation of the main drive shaft to result in a total of two ω rotation of the processing chamber during the one ω rotation of the main drive shaft.

In the illustrative embodiment, the second coupling means comprises a third drive member carried with the main drive shaft and a fourth drive member connected to the processing chamber. Means are provided for connecting the third and fourth drive members to provide a predetermined gear ratio.

In the illustrative embodiment, the predetermined gear ratio is at least 2:1 with the first drive member and the fourth drive member being larger, respectively, than the second drive member and the third drive member. In this manner, an attractive and stable system may be provided, without requiring an excessive number of fluid seals.

As used herein, the term "one ω" signifies any rotational velocity and is used as a relative term so that the term "two ω" is used to designate an angular velocity twice the angular velocity of one ω.

A more detailed explanation of the invention is provided in the following description and claims, and is illustrated in the accompanying drawings.

BRIEF DESCRIPTION OF THE DRAWINGS

FIG. 1 is an elevational view, taken partially in cross-section for clarity, of centrifugal processing apparatus constructed in accordance with one embodiment of the present invention;

FIG. 2 is a fragmentary enlarged view of a portion of the centrifugal processing apparatus of FIG. 1;

FIG. 3 is a cross-sectional view, primarily in diagrammatic form, of a sprocket and chain system utilized in connection with the apparatus of FIG. 1, substantially taken along the plane of the line 3—3 of FIG. 1.

DETAILED DESCRIPTION OF THE ILLUSTRATIVE EMBODIMENT

Figure 4:
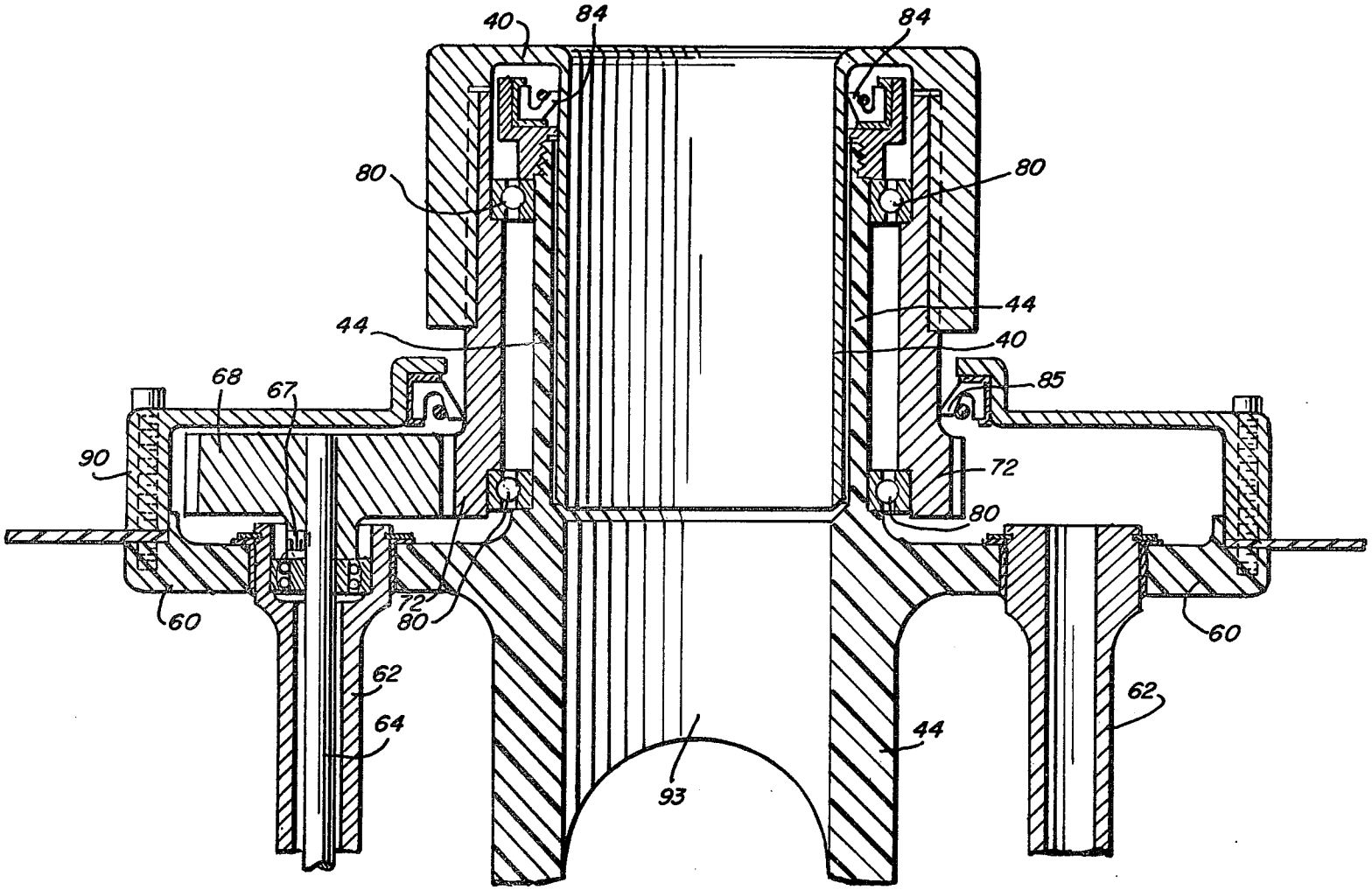
FIG. 4 is an enlarged view of a portion of the structure of FIG. 2.

Referring to the drawings, centrifugal processing apparatus is shown therein adapted for processing glycerolized red blood cells. It is to be understood, however, that the present invention is adaptable to use with various centrifugal processing apparatus, and the specific example given herein is merely for illustrative purposes.

The processing apparatus may include an outer cabinet (not shown) which may be suitably insulated and lined to permit refrigeration of its interior. Access to the interior may be provided by a hinged cover or the like and an external control panel (not shown) enables external control of the operation by an operator.

The red blood cell mass to be processed is subjected to centrifugal force in a processing chamber 10. Processing chamber 10 includes a pair of buckets 12, 13 which are mounted in diametrically opposed positions. Buckets 12, 13 are mounted on a cradle 14 which is rotatable about a central axis *a*. The opposed ends of cradle 14 define slots 15 into which pins 16 carried by buckets 12, 13 may be connected.

A stationary base 20 is provided, comprising a bowl 22 with a stationary or fixed torque arm 24 connected to a side of the bowl 22 and extending to a position whereby the distal end 26 of torque arm 24 defines an opening 28 that is coaxial with axis *a* to receive a fixed end 30 of cable segment 32. The walls defining opening 28 receive the polygonal base of a flexible sheath 34, which flexible sheath 34 defines a central axial bore receiving cable segment 32 snugly therein.

Fluid communication with buckets 12 and 13, which rotate as part of processing chamber 10, and with the non-rotating portions of the centrifugal processing system, is provided by the umbilical cable or tubing 32. Cable 32 defines separate passageways or conduits therein, and while four or five lumen tubing is preferable, it is to be understood that no limitation with respect to the particular size of the cable or the number of passageways is intended or should be implied. Further, tubing 32 could be circular or polygonal in cross-sectional configuration. Four tubes 36 extend from the four openings defined by four lumen tubing 32, for communication to and from buckets 12 and 13.

Cable 32 is suspended from a point above and axially aligned with processing chamber 10 by means of its fixed connection on axis *a* to torque arm 24 through flexible sheath 34 which acts to relieve the strain. A segment of cable 32 extends downwardly from its axially fixed position, radially outwardly, downwardly and around, and then radially inwardly and upwardly back to the processing chamber 10, as described below. The other end 38 of cable 32 is fixed to an axial position along axis *a* by its connection to a two ω rotating member 40 and it also carries a strain relief sheath 42, similar to strain relief sheath 34.

One ω rotation is initially imparted to the system by means of a central main drive shaft 44 which is coaxial with axis *a* and to which a pulley 46 is keyed. Pulley 46 is driven by a suitable electric motor at a first angular velocity one ω, with the one ω velocity imparted to shaft 44 and a two ω velocity imparted to member 40 in the manner to be described.

Main drive shaft 44 is journaled with respect to fixed base member 20 by a pair of ball bearings 48, located within a bearing housing 50 which is fastened by suitable bolts 52 to fixed base member 20. Thus bearing housing 50 is a fixed member which defines a fixed sprocket 54 about its circumference adjacent its upper surface.

Main drive shaft 44 carries a lower platform 58 and an upper platform 60. A plurality of hollow columns 62, preferably three columns 62 equally spaced about axis *a*, are connected between platforms 58 and 60. A transmission countershaft 64 extends through one of columns 62 and is connected at one end to a sprocket 66 and at its other end by bolt 67 to a gear 68. Thus sprocket 66 and gear 68 are spaced from each other by countershaft 64, but are both effectively carried by the main drive shaft 44, in that during rotation of main drive shaft 44 sprocket 66 and gear 68 are rotated about axis *a*.

Planetary rotation of sprocket 66 is imparted to sprocket 66 by means of a chain 70 which couples sprocket 66 to sprocket 54 (see FIG. 3). Sprocket 66 is keyed to countershaft 64 so that when main drive shaft 44 is rotated in a first direction, sprocket 66 will be rotated in the opposite direction.

Likewise, gear 68 is connected to countershaft 64 so that gear 68 will turn with sprocket 66. Gear 68 meshes with gear 72 to which two $\omega$ drive member 40 is fastened. Thus clockwise rotation of main shaft 44 will cause counterclockwise rotation of sprocket 66, countershaft 64 and gear 68. This will cause clockwise rotation of gear 72 which carries with it two $\omega$ drive member 40.

The gear ratio between sprocket 66 and sprocket 54 is identical to the gear ratio between gear 58 and gear 72. In this manner, one $\omega$ rotation of main drive shaft 44 will impart one $\omega$ rotation about axis *a* to platforms 58 and 60 which, when added to the planetary rotation of countershaft 64, will effectively impart two $\omega$ rotation to two $\omega$ drive member 40. Thus cradle 14, which is fastened to two $\omega$ drive member 40, will rotate at two $\omega$ about axis *a* during one $\omega$ rotation of main drive shaft 44 about axis *a*.

It is preferred that the gear ratio of sprockets 66 and 54, and the gear ratio of gears 68 and 72, be greater than 2:1 with sprocket 54 and gear 72 being larger in size, respectively, than sprocket 66 and gear 68. In this manner, the system can be relatively compact and attractive in appearance.

Gear 72 is separated from main drive shaft 44 by means of a pair of ball bearings 80, and the main drive shaft 44 effectively carries fluid seals 84, 85 and 86. Fluid seal 84 is effective to wipe two $\omega$ member 40, fluid seal 85 is effective to wipe gear 72 and to prevent fluid from entering from the outside to housing 90 enclosing gear 68, and fluid seal 86 is effective to prevent fluid from entering into housing 92 which encloses sprocket 66. It can be seen that only two fluid seals are needed using the principles of the present invention to seal the transmission countershaft and its associated elements from outside fluid.

If desired, the gear drive 68–72 and the sprocket drive 66–54 could be reversed. To this end, a fixed gear would be substituted for fixed sprocket 54 and a rotating gear, keyed to shaft 64, would be substituted for sprocket 66. Also, a pair of sprockets and chain arrangement would be substituted for gears 68 and 72. With this reversal, the countershaft 64 would rotate in the same direction of rotation as the main shaft 44, because clockwise rotation of the main shaft 44 would impart clockwise rotation to the rotating gear that is keyed to countershaft 64.

The main drive shaft 44 defines a central axial bore 93 with an opening 94 (FIG. 3) extending radially from the central bore 93 to the outside of the main drive shaft 44. As shown in FIG. 1, cable segment 32 extends from end 38 through central bore 93, through opening 94, out of main drive shaft 44, around the processing chamber 10 and up to arm 24, with ends 30 and 38 of the cable segment being connected along axis *a*.

Referring to FIG. 1, it is seen that an enclosure 96 is provided for enclosing processing chamber 10, with enclosure 96 comprising a top portion **96*a* and a lower portion 96*b*. Top portion 96*a* is removable from lower portion 96*b* in order to obtain access to processing chamber 10, allowing the operator to connect and remove buckets 12 and 13 and associated cable segment 32**.

Centrifugal processing apparatus has been provided which is simple in construction, relatively easy to clean and to load, uses relatively few fluid seals and utilizes a central drive shaft for maximum support and stability.

Although an illustrative embodiment of the invention has been shown and described, it is to be understood that various modifications and substitutions may be made by those skilled in the art without departing from the novel spirit and scope of the present invention.

What is claimed is:

1. Centrifugal processing apparatus, including:

a stationary base;

a processing chamber rotatably mounted with respect to said base for rotation about a predetermined axis;

a flexible umbilical cable segment for establishing communication with said processing chamber, one end of said cable segment being fixed with respect to said base substantially along said axis at one side of the processing chamber, the other end of the cable segment being attached substantially on said axis in rotationally locked engagement to the processing chamber, the improvement comprising, in combination:

a main drive shaft connected to said processing chamber, said main drive shaft being coaxial with said predetermined axis;

means for driving said main drive shaft at one $\omega$;

said main drive shaft defining a central bore and an opening extending radially from said central bore to the outside of said main drive shaft, said cable segment extending from said other end through said central bore and said radially extending opening, and out of said main drive shaft;

a transmission countershaft coupled to said base and main drive shaft adjacent one end thereof, said transmission countershaft coupled to said processing chamber and main drive shaft adjacent the other end thereof, said countershaft being parallely located with respect to said main drive shaft;

first means coupling said countershaft to said base and main drive shaft to cause rotation of said countershaft in response to rotation of said main drive shaft;

second means coupling said countershaft to said processing chamber and main drive shaft to transmit one $\omega$ rotation to said processing chamber during rotation of said countershaft with said transmitted one $\omega$ rotation being added to said one $\omega$ rotation of said main drive shaft to result in a total of two $\omega$ rotation of said processing chamber during one $\omega$ rotation of said main drive shaft.

2. Centrifugal processing apparatus as described in claim 1, said first coupling means comprising a first drive member affixed to said base and a second drive member carried with said main drive shaft, with means coupling said first and second drive members to establish a predetermined gear ratio, and means connecting said countershaft to said second drive member.

3. Centrifugal processing apparatus as described in claim 1, said second coupling means comprising a third drive member carried with said main drive shaft and a fourth drive member connected to said processing chamber; means connecting said third and fourth drive members to provide a predetermined gear ratip; and means connecting said countershaft to said third drive member.

4. Centrifugal processing apparatus as described in claim 2, said second coupling means comprising a third drive member carried with said main drive shaft and a fourth drive member connected to said processing chamber; means connecting said third drive member to said fourth drive member to cause a gear ratio that is equal to said predetermined gear ratio; and means connecting said countershaft to said third drive member; said gear ratio being at least 2:1 with said first drive member and said fourth drive member being larger, respectively, than said second drive member and said third drive member.

5. Centrifugal processing apparatus as described in claim 1, said first coupling means comprising a first sprocket or pulley fixed to said base and a second sprocket or pulley carried with said main drive shaft, with a chain or belt connected about both sprockets, and means connecting said countershaft to said second sprocket or pulley.

6. Centrifugal processing apparatus as described in claim 1, said second coupling means comprising a first gear carried with said main drive shaft and a second gear meshed with said first gear and connected to said processing chamber; and means connecting said countershaft to said first gear.

7. Centrifugal processing apparatus as described in claim 5, said second coupling means comprising a first gear carried with said main drive shaft and a second gear meshed with said first gear and connected to said processing chamber; and means connecting said countershaft to said first gear.

8. Centrifugal processing apparatus as described in claim 7, said first and second sprockets or pulleys having the same gear ratio as the gear ratio of said first and second gears.

9. Centrifugal processing apparatus as described in claim 8, said gear ratio being at least 2:1 with said first sprocket or pulley and said second gear being larger, respectively, than said second sprocket or pulley and said first gear.

10. Centrifugal processing apparatus as described in claim 1, said countershaft being operative to turn in a direction opposite to the direction of said main drive shaft.

11. Centrifugal processing apparatus as described in claim 1, said first coupling means comprising a first gear fixed to said base and a second gear meshed with said first gear and carried with said main drive shaft, and means connecting said countershaft to said second gear.

12. Centrifugal processing apparatus as described in claim 11, said second coupling means comprising a first sprocket or pulley carried with said main drive shaft and a second sprocket or pulley connected to said processing chamber; a chain or belt connected about both sprockets or pulleys; and means connecting said countershaft to said first sprocket or pulley.

13. Centrifugal processing apparatus as described in claim 12, said first and second sprockets or pulleys having the same gear ratio as the gear ratio of said first and second gears.

* * * * *